US006227018B1

(12) United States Patent
Miller et al.

(10) Patent No.: US 6,227,018 B1
(45) Date of Patent: May 8, 2001

(54) DISPLAY CASE SECURITY COVER

(75) Inventors: Benson Lee Miller; Paul Townsend Scherer, both of Lexington, KY (US)

(73) Assignee: LockNET, L.L.C., Nicholasville, KY (US)

( * ) Notice: Subject to any disclaimer, the term of this patent is extended or adjusted under 35 U.S.C. 154(b) by 0 days.

(21) Appl. No.: 09/342,309

(22) Filed: Jun. 29, 1999

(51) Int. Cl.[7] ..... E05B 73/00; A47F 9/00
(52) U.S. Cl. ..... 70/58; 312/137
(58) Field of Search ..... 70/18, 58, 158, 70/159; 109/49.5; 312/114, 137, 138.1, 265.6, 208.3, 293.3

(56) References Cited

U.S. PATENT DOCUMENTS

| | | | | |
|---|---|---|---|---|
| 3,410,122 | * | 11/1968 | Moses | 70/58 |
| 3,433,269 | * | 3/1969 | Sackett, Sr. | 220/324 X |
| 3,868,040 | | 2/1975 | Langmack, Jr. et al. . | |
| 3,945,227 | | 3/1976 | Reiland | 70/58 |
| 4,418,551 | | 12/1983 | Kochackis | 70/18 |
| 4,804,877 | | 2/1989 | Harwood | 312/114 |
| 4,929,862 | | 5/1990 | Hamilton et al. | 312/138.1 |
| 4,973,109 | | 11/1990 | Diedrich | 312/265.6 X |
| 5,076,531 | * | 12/1991 | Delaney | 70/58 X |
| 5,165,262 | | 11/1992 | Brem et al. | 70/158 |
| 5,201,822 | | 4/1993 | Chen | 312/326 X |
| 5,263,344 | | 11/1993 | Madison | 70/58 X |
| 5,483,905 | | 1/1996 | Johansson | 109/79 |
| 5,537,779 | | 7/1996 | Jackson | 49/62 |
| 5,622,121 | | 4/1997 | Holler | 109/49.5 |
| 5,655,462 | | 8/1997 | Holler | 109/49.5 |
| 5,675,997 | * | 10/1997 | Hulak | 70/58 X |
| 5,733,021 | | 3/1998 | O'Neill et al. | 312/114 |
| 5,791,749 | | 8/1998 | O'Neill et al. | 312/117 |
| 5,816,076 | | 10/1998 | Biedermann et al. | 70/57 |

* cited by examiner

*Primary Examiner*—James O. Hansen
(74) *Attorney, Agent, or Firm*—Wood, Herron & Evans, L.L.P.

(57) ABSTRACT

A security cover for display cases includes cooperating generally L-shaped rigid frangible-resistant panels. A hook-shaped lower edge of each panel is coupled to an anchor rail fixedly mounted to the base of the display case. Each panel is then pivoted upwardly to cover a portion of the display case. The panels include flanges along an upper terminal edge thereof. The flanges are mated together in a U-shaped lock bar and a lock to securely couple the panels together and enclose the glass faces of the display case in a frangible-resistant protective cover to inhibit breakage of the glass faces and theft of the contents of the display case.

3 Claims, 4 Drawing Sheets

DISPLAY CASE SECURITY COVER

BACKGROUND OF THE INVENTION

This invention relates to a security cover for preventing unauthorized access to the contents within a display case.

Many valuable items, such as jewelry, are displayed for sale by retailers in display cases which have transparent, commonly glass, faces through which the items in the display case can be viewed by customers, salespeople and the like. Commonly, the display cases include a glass front face, glass top face, and often a glass rear face and glass end faces. These display cases are usually elevated off of the floor by a wooden support structure such as a base or the like. The display cases are fully enclosed and usually kept locked since the retailers want to limit access to the valuable items and prevent shoplifting, breakage, etc. The glass faces are provided, so that customers can view the jewelry or the valuable items in the display case through the top and sides of the case.

The multiple glass faces of the display case allow the items therein to be viewed at different angles and to let a maximum amount of light in the display case. Since these display cases are usually locked, when a customer wants to handle a particular item or have a closer view of it, a salesperson unlocks the display case and removes the item for the customer's viewing. Therefore, for optimum merchandising of the contents of the display case, a customer's visual access to the items must be maximized.

The use of glass faced display cases presents a problem during times when the establishment is closed. The problem develops when the valuable items are left in the display case overnight, which is often done through the lack of storage space for the valuable items other than in the display case and due to the time involved in removing and subsequently replacing all the items.

One common practice for thieves is a "smash and grab" procedure. In a "smash and grab" robbery the thieves first break into the establishment and then smash at least one of the glass faces of the display case. The thief or his accomplice can then remove the valuable items from the display case very quickly. Typical burglar alarms are ineffective in these situations because the robbery often takes place so quickly that the thieves can flee before the police can respond to the alarm. Thus, there is a need to protect the glass display cases so that the glass faces cannot be quickly and easily shattered and the contents removed. The longer it takes thieves to break into the glass display case, the greater is the likelihood that they will be caught as it gives police and security personnel more time to respond to the burglar alarm.

One response to these types of burglaries is to fortify the jewelry case against such "smash and grab" type thefts. However, this must be done without compromising the visual access during business hours to the jewelry. One possible solution to this problem is to apply an armor-plated transparent film to the glass of the jewelry display case. The armor-plated film inhibits the ability of a thief to break through the glass faces. The protective film may be effective in many situations, but it is not impenetrable and can be broken into. Additionally, although the film is substantially transparent, it is not removable and usually darkens over time which inhibits visual access to the contents of the display case and diminishes the appealing nature of the jewelry displayed therein.

Another type of device is a protective screen which can be pulled down over the display case or similar structure to protect the goods therein. However, such screen members have many disadvantages including the fact that all of the multiple faces of the display case are not typically covered by the screens. Further, when the screens are not in use they are retracted into a housing which can obstruct a customer's view and is not aesthetically pleasing in the jewelry case environment. Further, it is often possible to pry or lift the edges of the screen member away from the display case to gain access to the contents.

Other types of protective covers are permanently affixed and have proven very useful in environments other than display cases. Such covers are always attached to the item being protected, even when not in use. This is aesthetically displeasing to the customers viewing items in the display case. Additionally, such permanently mounted covers would hinder the sales personnel's access to the items in the display case and prevent free movement around the cases.

Other types of covers include foldable enclosures which are intended to cover the display cases. These devices have the disadvantage that they are not adaptable to a display case having non-planar or irregularly shaped glass faces. Additionally, the foldable covers typically include a number of hinges which can be easily removed by the thief to separate the various sections of the cover and then provide access to the glass faces of the display case.

Therefore, it is apparent that there is a need for an improved security cover for display cases having glass faces that is robust and cannot be easily defeated by would-be thieves and prevents access to the contents of the display cases during non-business hours. Moreover, the security cover must not be difficult for a user to employ nor hinder a salesperson's access to the items in the display case when the security cover is not in use.

SUMMARY OF THE INVENTION

These and other objectives of the invention have been attained by a new security cover which, in a presently preferred embodiment, includes cooperating general L-shaped rigid, frangible-resistant panels. The panels have a solid attachment point to the display case to resist blows by would-be thieves in an attempt to dislodge the security cover from the display case.

Commonly, display cases have a base which includes a sheet of particleboard, plywood or other similar material located immediately below the display area of the display case. Each of the L-shaped panels is secured at a bottom edge thereof by an anchor in the form of a rail which is fixedly mounted to the base of the display case. Once the anchor rail is screwed, bolted or otherwise mounted to the base of the display case with about a ⅜-inch standoff from the display case, a curved or hook-shaped proximal edge of each L-shaped panel is hooked onto the rail and the panel is then pivoted upwardly until a terminal flange opposite the hook-shaped edge of the panel is positioned on top of the display case. The flange at the upper terminal edge of each panel abuts against a cooperating flange on the mating panel typically along the longitudinal center line of a top face of the display case.

When installed, a generally vertical pane of one of the L-shaped panels covers the front glass face of the display case and a portion of the top face of the display case is covered by a generally horizontal pane of the panel. Similarly, the rear face of the display case is covered by the vertical pane of the complementary panel and the remaining portion of the top face is covered by the horizontal pane of the complementary panel.

Once the mating panels are installed on the display case, the flanges are juxtaposed together and a lock bar is installed to cover the flanges and secure them together. The lock bar is slid longitudinally relative to the flanges so that apertures in the flanges and the lock bar register with each other and a lock or similar device is installed through the apertures thereby securely enclosing the glass portion of the display case with an impact resistant protective security cover. The lock bar and other features of this invention serve as structural members to provide added strength to the cover to resist attack. Preferably, the panels of the security cover are opaque to prevent visual access to the contents in the display case once the security cover is installed. The security cover can be retrofit onto existing display cases or provided as original equipment with new display cases.

This security cover, according to the presently preferred embodiment of this invention, can be easily and conveniently installed onto the display case at the close of business and, likewise, easily removed once the store is opened for business and does not detrimentally impact the viewing of the items in the display case or the access to those items by the salesperson during normal business operations. Furthermore, the security cover does not diminish the visual access to the items in the display case because it is entirely removed therefrom during normal business hours. Moreover, the security cover, when installed, is securely anchored to the base of the display case and entirely encloses the glass portions of the display case so that it cannot be easily broken, removed or dismantled by a would-be thief.

BRIEF DESCRIPTION OF THE DRAWINGS

The objectives and features of the invention will become readily apparent from the following detailed description taken in conjunction with the accompanying drawings in which.

DETAILED DESCRIPTION OF THE INVENTION

Figure 1:
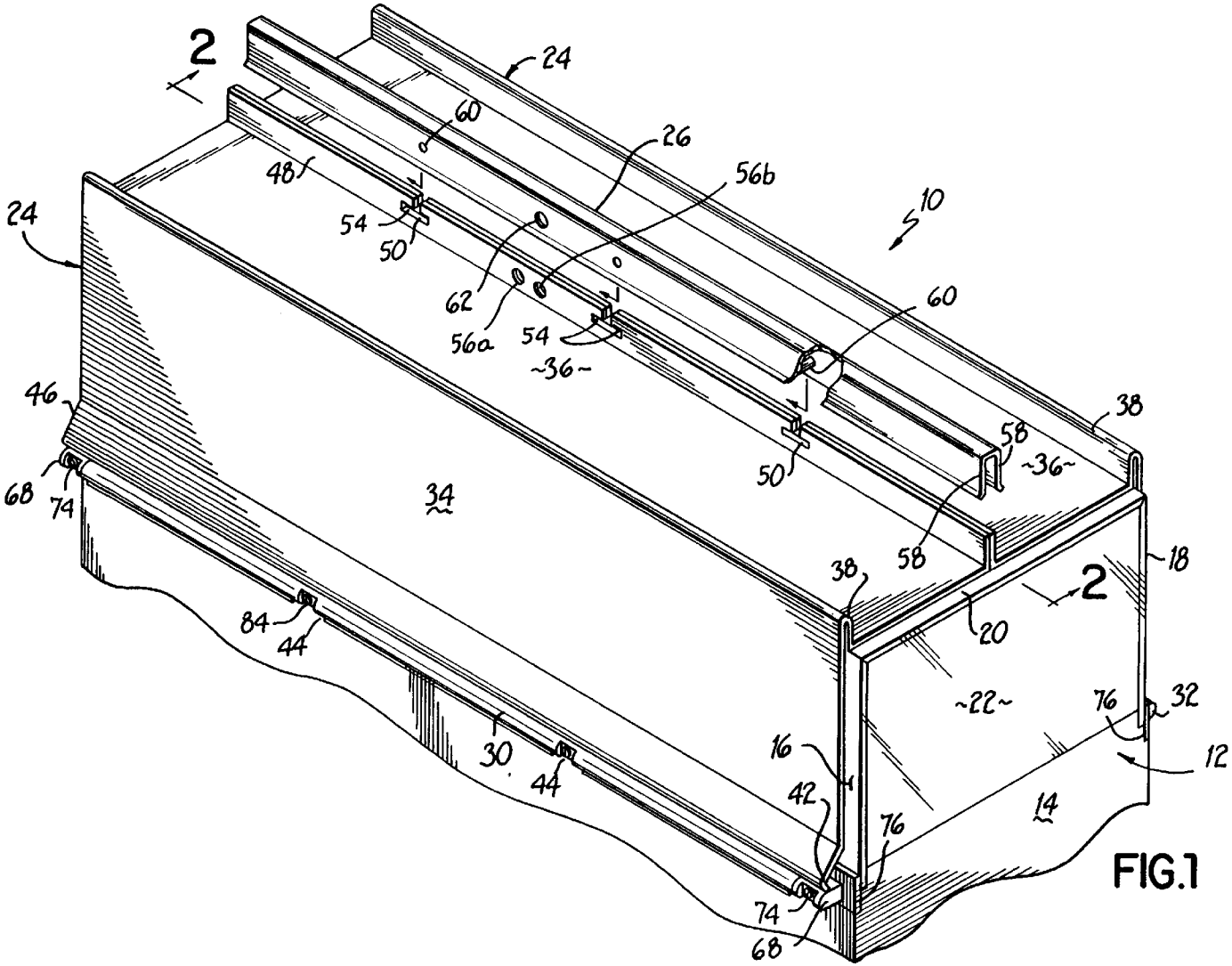
FIG. 1 is perspective view of a presently preferred embodiment of a security cover according to this invention being installed onto a display case.

Referring to FIG. 1, a first presently preferred embodiment of a security cover 10 for a display case 12 is shown. The display case 12, commonly used in retail establishments for merchandising jewelry or other valuable items, includes a typically wooden base 14 supporting a glass enclosed display area containing the jewelry or similar items. The display area is enclosed by transparent glass for viewing of the items and includes a glass front face 16, a glass rear face 18, a glass top face 20 and glass end faces 22. Commonly, the rear face 18 of the display case 12 may be glass or another material and include sliding and lockable doors (not shown) for convenient access to the contents of the display case 12 by a salesperson. It should be readily understood by those skilled in the art that the display case shown and described herein is for exemplary purposes only and should not be considered a limitation upon the scope of this invention as defined by the appended claims. For example, the present invention is readily useful for a variety of display case sizes, configurations, geometries and designs.

Figure 6:
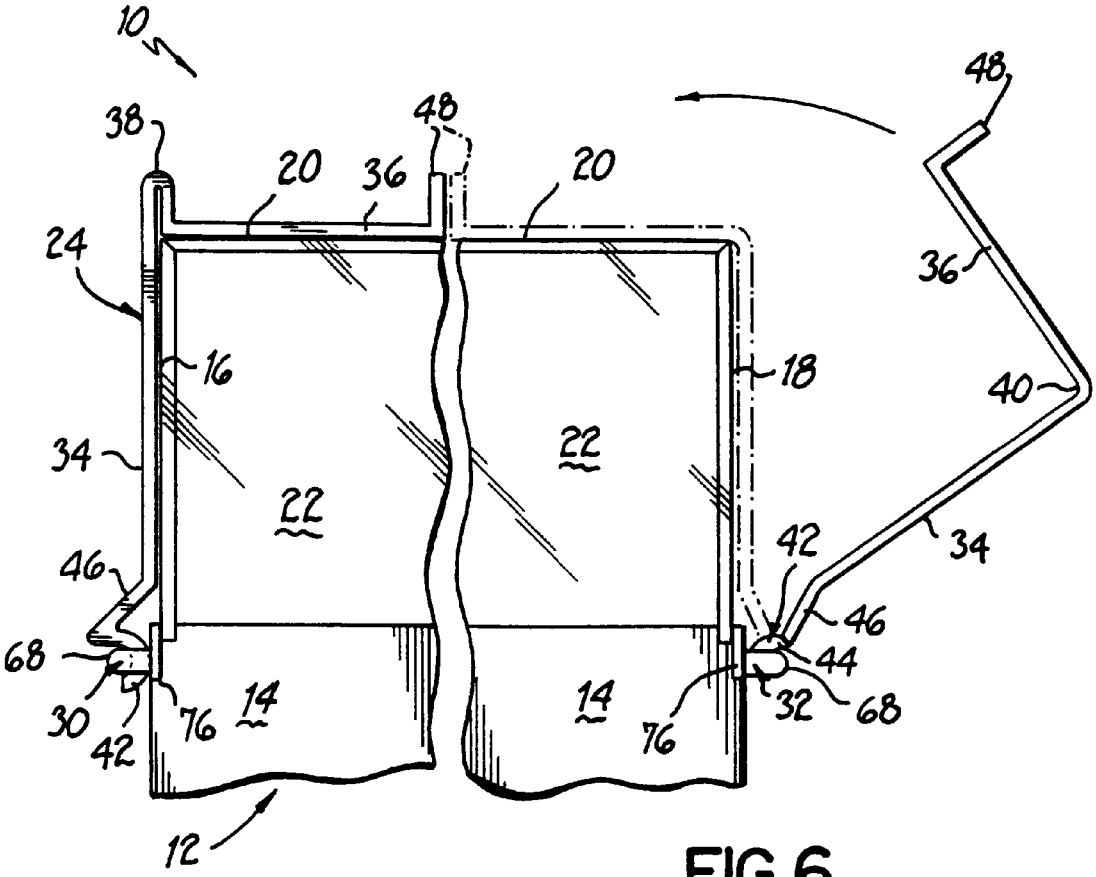
FIG. 6 is a view of the first and a second presently preferred embodiments of the panels according to this invention being coupled to the anchor rail on the display case and pivoted into place.

The security cover 10, according to a first presently preferred embodiment of this invention, as shown in FIGS. 1 and 6, includes a pair of generally L-shaped mating panels 24 which are secured together by an elongate lock bar 26 and a lock 28. The panels 24 are releasably mounted to the base 14 of the display case 12 by an anchor in the form of a front rail 30 and a rear rail 32. The front and rear rails 30, 32 are positioned immediately below the front and rear glass faces 16, 18, respectively, of the display case 12 and are mounted to the base 14 as will be described later herein. Each panel 24 of the security cover 10 is generally L-shaped and, when installed on the display case 12, includes a generally vertical pane 34 juxtaposed to and covering the glass front face 16 or glass rear face 18 and a generally horizontal pane 36 juxtaposed to and covering at least a portion of the glass top face 20 of the display case 12 in the presently preferred embodiment. Panes of the panels 24 may be included for covering the end faces 22 of the display case 12 as required within the scope of this invention. Each panel 24 is preferably molded or otherwise formed of an opaque plexiglass, Lexan®, ABS plastic or similar material. Preferably, the panels 24 are a frangible-resistant rigid material which is resistant to breaking, mutilation, fracture or the like. Additionally, the panels 24 are preferably opaque to inhibit visual access to the contents of the display case 12 when installed thereon. The horizontal and vertical panes 36, 34 are rigidly connected to conform to the geometry of the display case 12 to which they are installed. Depending upon the forming technique used in manufacturing the panels 24, a generally vertical lip 38 may be included at the juncture between the vertical and horizontal panes 34, 36 or, as shown in a second presently preferred embodiment of the panels in FIG. 6, a smoothly continuous corner 40 may be formed at the juncture between the panes 34, 36. The vertical lip 38 also serves as a structural member to provide added strength to the display cover 10 in this area to distribute the stresses from hammer or other blows and prevents such forces from being transmitted to the attachment points of the rails 30, 32.

A hook 42 extends the length of each panel 24 along a lower proximal edge of the vertical pane 34 for releasably coupling the panel 24 to the anchor rail 30, 32. Depending upon the mounting mechanism for the anchor rail 30, 32, a notch 44 may be provided in the hook 42 to accommodate the mounting mechanism. Preferably, a sloped sill 46 is also included along the lower portion of the vertical pane 34 of each panel 24. The sloped sill 46 protrudes from the vertical pane 34 and overhangs the anchor rail 30, 32 as shown in FIG. 6 so that a downwardly directed blow by a hammer or other blunt instrument is deflected from impacting and damaging the anchor rail 30, 32.

An upstanding flange 48 extends the length of each panel 24 along a distal edge thereof on the horizontal pane 36 of the panel. The flange 48 of each panel 24 is juxtaposed to the flange 24 of the complimentary panel 24 generally along the longitudinal center line of the top glass face 20 of the display case 12 in the embodiments shown in FIGS. 1 and 6. The flanges 48 each include a plurality of spaced inverted T-slots 50 which correspond in size, location and configuration with the T-slots 50 in the flange 48 of the mating panel 24. The T-slot 50 includes a generally vertical opening or mouth 52 connected to oppositely directed stems 54. Additionally, at least one and preferably two lock apertures 56*a*, 56*b* are provided in the flanges 48.

Figure 2:
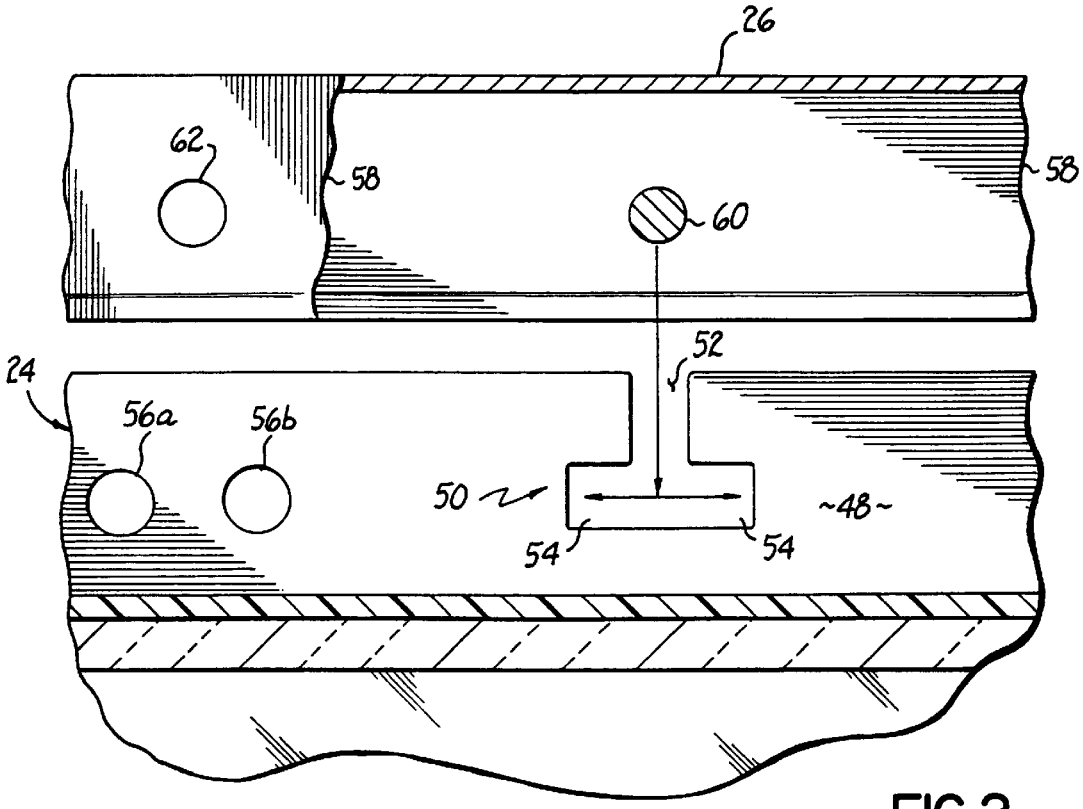
FIG. 2 is an enlarged cross-sectional view taken along line 2—2 of a lock bar being installed onto the juxtaposed flanges of the panels of the security cover of FIG. 1.
Figure 3:
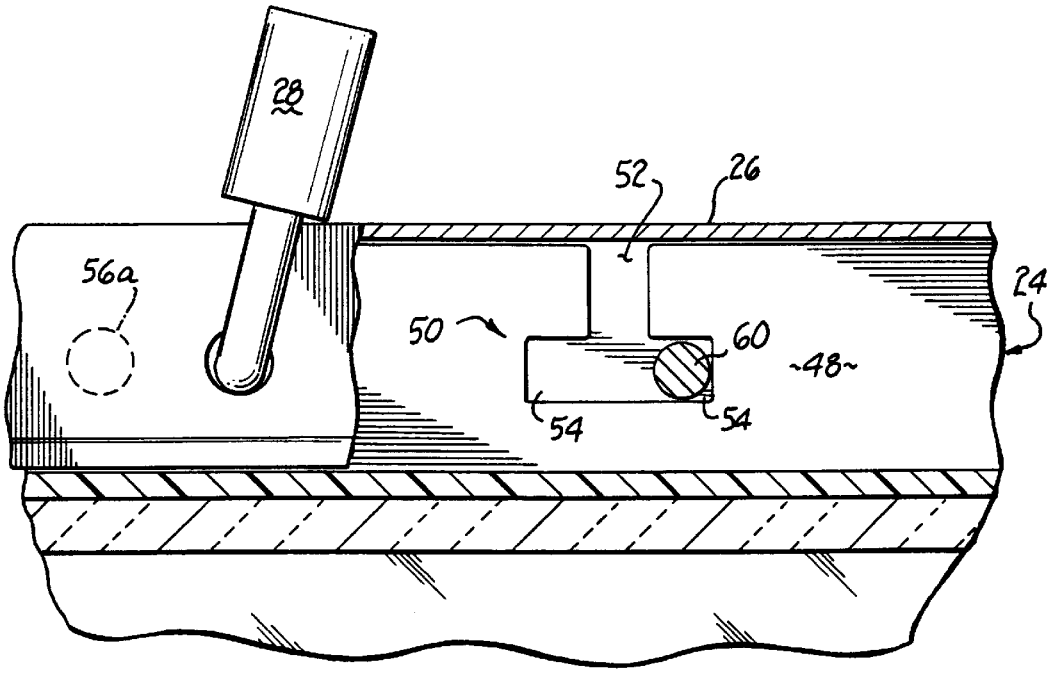
FIG. 3 is a view similar to FIG. 2 with the lock bar and a lock installed onto the flanges.

The lock bar 26, as shown in FIGS. 1–3, has a generally inverted U-shaped configuration with a pair of spaced sidewalls 58. The lock bar 26 is also preferably made out of 0.060 inch thick stainless steel. A plurality of pins 60 extend between the sidewalls 58 of the lock bar 26 at spaced locations corresponding to the locations of the T-slots 50 in the flanges 48. Similarly, at least one lock bar aperture 62 is provided through each of the sidewalls 58 of the lock bar 26. For installation of the lock bar 26, the pins 60 are aligned with the mouth 52 of the T-slots 50 and the lock bar 26 is pushed downwardly with the flanges 48 positioned between the spaced sidewalls 58 thereof until the pins 60 bottom out in the T-slots 50. The lock bar 26 is then slid or translated longitudinally relative to the panels 24 in either direction so that each pin 60 is seated within one of the stems 54 of the respective T-slot 50. Once the pins 60 are inserted into the stems 54 of the T-slot 50, the lock bar apertures 62 register with one of the lock apertures 56*a*, 56*b* in the flanges 48 so that the pad lock or other locking mechanism 28 can be inserted through the lock apertures 56*a*, 56*b* and the lock bar apertures 62 to securely enclose the faces of the display case 12. In addition to joining the panels 24 together, the lock bar 26 provides a structural member at the center of the display case 12 to withstand the stresses of an attack.

Figure 4:
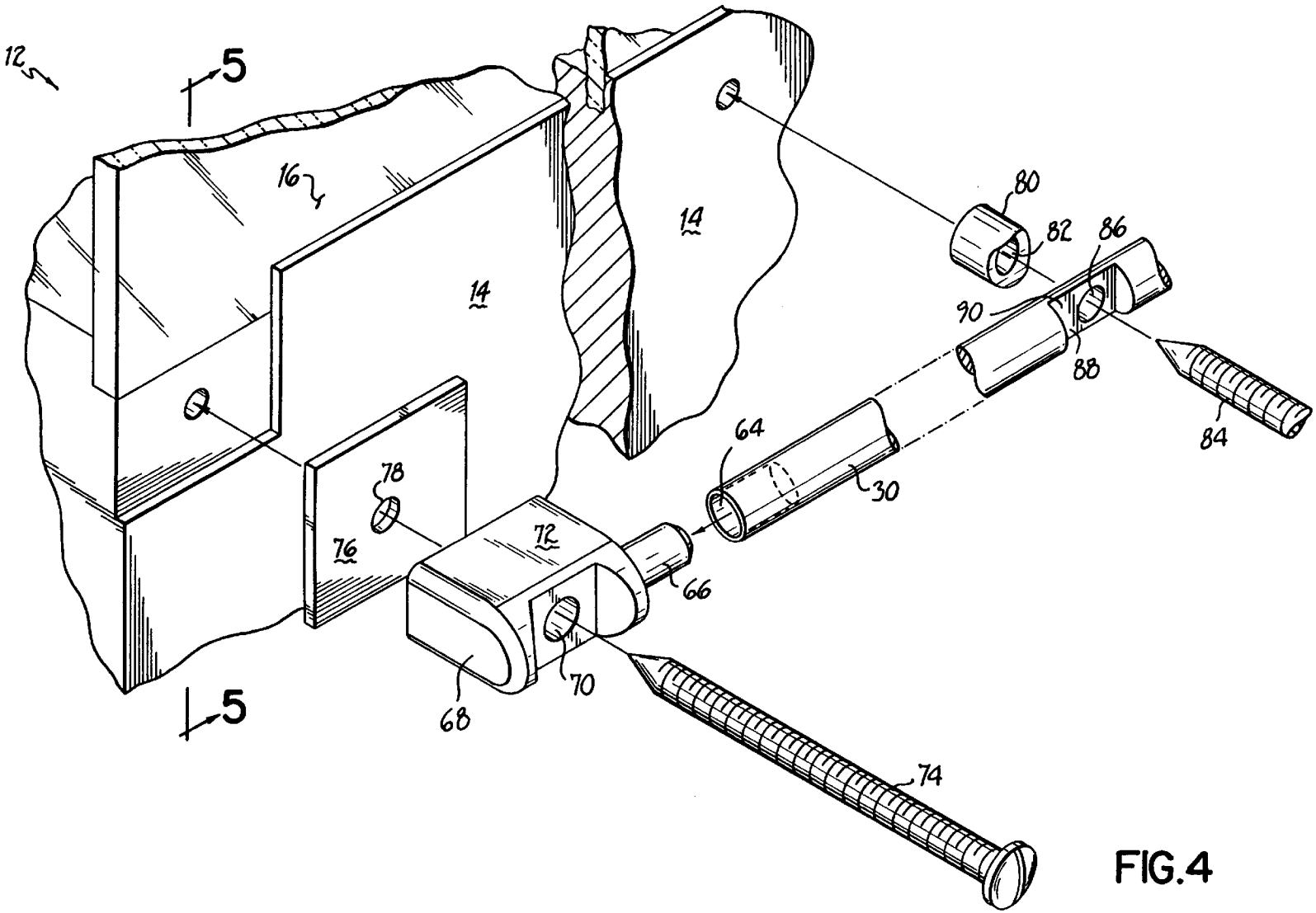
FIG. 4 is an enlarged diss-assembled perspective view of an anchor rail being installed onto a base of the display case according to the presently preferred embodiment of this invention.
Figure 5:
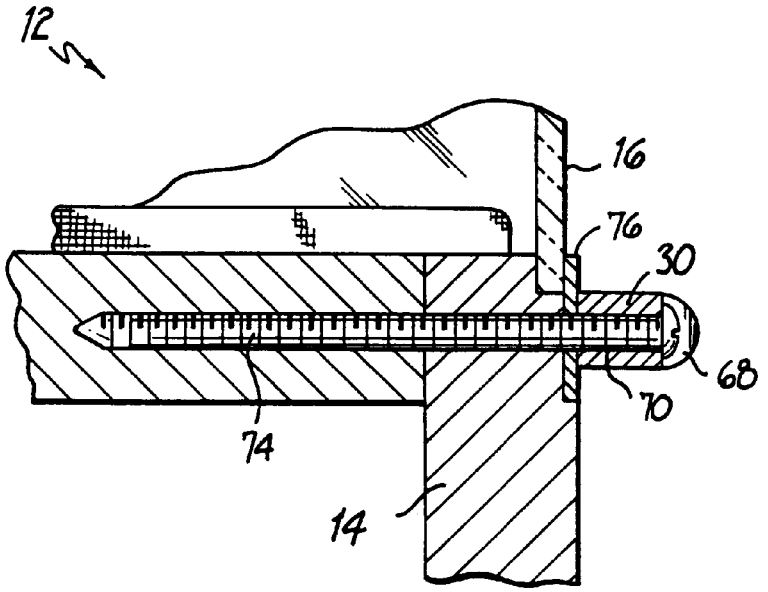
FIG. 5 is a cross-sectional view taken along 5—5 of FIG. 4 of the installed anchor rail.

Referring to FIGS. 4 and 5, a mounting mechanism for each anchor rail 30, 32 is shown. The anchor rail 30, 32 is preferably a circular metal rail with a tubular opening 64 on each end thereof. A post 66 projecting from an end cap 68 is received into the tubular opening 64. The end cap 68 also includes a bore hole 70 through a body portion 72 thereof. The end cap 68 is mounted to the base 14 of the display case 12 by a preferably three inch long screw 74 inserted through the bore hole 70 and screwed into a wooden, particleboard, plywood or other similar material portion of the base 14. Preferably, a metal, generally square plate 76 having a central hole 78 therethrough is positioned between the end cap 68 and the base 14 of the display case 12 for more secure mounting of the rail 30, 32. The opposite end of the rail 30, 32 is likewise mounted to the base 14 with an end cap 68, screw 74 and plate 76.

Spaced along the length of the rail 30, 32 between the end caps 68 are a plurality of spacers 80 positioned between the rail 30, 32 and the base 14 of the display case 12. The spacers 80 include a central bore hole 82 through which a screw 84 is inserted through a hole 86 in the bottom 88 of a notch 90 on the rail 30, 32 to firmly anchor the rail 30, 32 approximately three-eighths of an inch from the base 14. Preferably, the screws 74, 84 are inserted into a typically three-quarter inch thick particleboard, plywood or other wooden portion of the base 14 underlying the display area of the display case 12, as shown in FIG. 5. As such, the rail 30, 32 is securely mounted to the display case 12 for anchoring the panels 24 of the security cover 10 to resist removal, mutilation, dislodgment or the like.

It should be readily understood that the installation of the anchor rails 30, 32 and other components of the security cover 10 according to a presently preferred embodiment of this invention are shown and described for exemplary purposes only.

After the front and rear anchor rails 30, 32 are mounted to the base 14 of the display case 12, the respective panels 24 are installed by initially hooking the proximal hook-shaped edge 42 of each panel 24 onto the anchor rail 30, 32 with the vertical pane 34 spaced from the front or rear face 16, 18 of the display case 12 as shown in FIG. 6. With the hook 42 engaged on the rail 30, 32, the panel 24 is pivoted upwardly toward the display case 12 until the vertical pane 34 is juxtaposed to the front or rear face 16, 18 of the display case 12 and the horizontal pane 36 is juxtaposed to the top face 20 of the display case 12. After the complementary panel 24 is likewise installed, the lock bar 26 is installed onto the juxtaposed flanges 48 with the pins 60 inserted into the mouth 52 of the respective T-slots 50. The lock bar 26 is then slid longitudinally to seat the pins 60 within one of the stems 54 of the T-slots 50 and thereby register the lock bar apertures 62 with the lock apertures 56*a* or 56*b* on the flanges 48. The padlock or other locking device 28 is then inserted through the registered lock apertures 56*a* or 56*b* and lock bar apertures 62 and the installation of the security cover 10 according to a presently preferred embodiment of this invention is complete.

Removal of the security cover 10 is likewise easily accomplished by a salesperson by removal of the lock 28, translation of the lock bar 26 to align the pins 60 with the mouth 52 of the respective T-slots 50, removal of the lock bar 26 and pivotal removal of each of the panels 24 for storage and subsequent reuse. As such, the security cover 10 according to the presently preferred embodiment of this invention provides a frangible-resistant protective cover for the glass faces of the display case 12. Moreover, the security cover 10 is completely removable from the display case 12 when not in use and securely anchored thereto when in use. Furthermore, the use of the security cover 10 does not detrimentally impact the viewing of the contents of the display case 12 during normal business hours nor hinder the access to those contents by salespersons.

It should be readily understood that the presently preferred embodiments of the security cover 10 include two complimentary or mating generally L-shaped panels 24 with flanges 48 that are juxtaposed directly together on the top face 20 of the display case 12. However, other arrangements are readily within the scope of this invention. For example, panels which are not L-shaped, complementary panels one of which is L-shaped having a horizontal pane that covers the entirety of the top face and security covers which include intermediate panel sections which cover a portion or all of one of the faces of the display case are within the scope of this invention. Moreover, any arrangement of panels which, in combination, are juxtaposed to and/or cover the various faces of the display case are also within the scope of this invention.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

What is claimed is:

1. A security cover for a display case having a base and a plurality of generally transparent faces through which contents of the display case can be viewed, the security cover comprising:

an anchor adapted to be fixedly mounted to the base of the display case;

a pair of rigid, frangible-resistant panels each having a proximal edge adapted to be releasably coupled to the anchor and a distal edge, the distal edges of the panels being adapted to confront one another when installed on the display case and be releasably coupled together to prevent their unauthorized removal, wherein the distal edge of each panel includes a flange with a lock aperture, the flanges of the panels being mirror images of each other and the lock apertures being aligned so that a lock may be inserted through the aligned lock apertures to releasably couple the panels together on the display case, the panels being so formed as to in combination conform to and cover the faces of the display case to inhibit unauthorized access to the contents of the display case;

a lock bar having a pair of spaced sidewalls, a lock bar aperture in each sidewall and a pin extending between the sidewalls; and a slot in the flange of each panel;

wherein when the panels are installed on the display case and the flanges juxtaposed to each other with the respective slots aligned the lock bar is adapted to be coupled to the flanges with the pin inserted into the aligned slots and the lock inserted into the lock apertures and the lock bar apertures.

2. A security cover for a display case having a base and a front face, a top face and a rear face through which contents of the display case can be viewed, the security cover comprising:

a front rail and a rear rail each spaced from and adapted to be fixedly mounted to the base proximate the front face and the rear face, respectively;

a pair of rigid, frangible-resistant generally L-shaped panels each having a proximal edge on a vertical pane thereof and a terminal edge with a flange on a horizontal pane thereof, each proximal edge being adapted to be releasably coupled to one of the rails with one of the vertical panes being juxtaposed to the front face and the other vertical pane being juxtaposed to the rear face of the display case, the horizontal panes of the panels being juxtaposed to the top face of the display case with the flanges of the panels being adapted to confront one another when installed on the display case and be releasably coupled together, the panels in combination covering the faces of the display case to inhibit unauthorized access to the contents of the display case;

at least one slot and at least one lock aperture in each flange, the slots and the lock apertures of the flanges of the panels being aligned when the panels are installed on the display case; and a U-shaped lock bar having a pair of spaced sidewalls and aligned lock bar apertures in each sidewall and a pin extending between the sidewalls;

wherein when the panels are installed on the display case and the flanges juxtaposed to each other with the respective slots aligned the lock bar is coupled to the flanges with the pin inserted into the aligned slots and a lock inserted into the lock apertures and the lock bar apertures to releasably couple the panels together on the display case.

3. The security cover of claim 2 wherein the proximal edge of each panel includes a hook adapted to releasably couple the panel to the anchor by initially engaging the anchor with the hook and pivoting the panel upwardly until the distal edges of the panels are juxtaposed together.

* * * * *